US005245788A

United States Patent [19]

Riegelman

[11] Patent Number: 5,245,788

[45] Date of Patent: Sep. 21, 1993

[54] CASEMENT WINDOW

[75] Inventor: Harry M. Riegelman, Arlington, Tex.

[73] Assignee: M & G Manufacturing Company Inc., Waukee, Iowa

[21] Appl. No.: 823,264

[22] Filed: Jan. 21, 1992

[51] Int. Cl.[5] ..... E05C 21/02

[52] U.S. Cl. ..... 49/465; 49/498.1

[58] Field of Search ..... 49/463, 466, 504, 485, 49/498, 465; 52/204, 214

[56] References Cited

U.S. PATENT DOCUMENTS

| | | | |
|---|---|---|---|
| 2,953,824 | 9/1960 | Minick | 49/498 X |
| 3,057,023 | 10/1962 | Hewt | 49/466 X |
| 3,226,779 | 1/1966 | Rust | 49/463 |
| 3,796,010 | 3/1974 | Carlson | 49/465 X |
| 4,106,236 | 8/1978 | Oliphant | 49/465 X |
| 4,569,170 | 2/1986 | Gartner | 52/204 |
| 4,712,330 | 12/1987 | Beirnes | 49/485 X |
| 4,726,149 | 2/1988 | Tryba | 49/465 |
| 4,958,468 | 9/1990 | Nola | 52/204 |

*Primary Examiner*—Peter M. Cuomo
*Assistant Examiner*—Jerry Redman
*Attorney, Agent, or Firm*—G. Brian Pingel

[57] ABSTRACT

An improved tip-in casement window has an outer frame, an inner sash, and elongated gasket strips. When the sash is assembled in the outer frame, an operatively continuous seal around the sash is created through the use of a downward facing gasket strip, thereby greatly increasing the insulative capability of a tip-in casement window.

4 Claims, 4 Drawing Sheets

CASEMENT WINDOW

BACKGROUND OF THE INVENTION

1. Field of the Invention

The present invention relates in general to tip-in casement windows, and more specifically relates to an improved construction for such casement windows to provide a simple yet effective way to greatly increase the insulative capability of such windows.

2. Description of the Prior Art

Tip-in casement windows have been known in the art for many years and numerous types of tip-in casement window constructions are available in the market today. The most common type of casement window construction has an outer frame and an inner sash frame which houses one fixed glass pane unit and one slidable glass pane unit. The outer frame has a continuous inwardly directed retaining flanges which are located on the outer edges of the side and top portions of the frame. The bottom portion of the frame also has an inwardly directed retaining flange, but this flange is located toward the rear edge of the bottom portion. The sash has outwardly directed flanges designed to mate with the appropriate retaining channels of the frame so that the sash may be "tipped-in" into the frame and thereby be secured through retaining clips located at the top of the sash. This common design allows for the simple and easy assembly of such casement windows.

Although the above described common casement window construction has proven to be commercially successful in that it provides an effective means to assemble the sash into the wall frame, such construction does not provide a satisfactory means to insulate and seal the joint between the sash and the outer frame. Typically, the top and side flanges of the sash have a front gasket which provides for an uninterrupted seal for those upper portions of the sash. However, because the bottom flange of the sash is offset from the sash top and side flanges, it is not possible to have an uninterrupted seal completely around the front of the sash. Therefore, this known design does not provide for effective bottom sealing. In contrast to the prior art construction, the present invention includes a bulb-type bottom seal construction to provide an improved tip-in casement window with an increased insulative capability.

SUMMARY OF THE INVENTION

The present invention provides an improved tip-in casement window. The casement window construction of the present invention includes an outer frame having inwardly directed retaining flanges, an inner sash frame having outwardly directed flanges, and elongate gasket strips located on the frontward facing surfaces of the top and side sash flanges, the rearward facing surface of the sash bottom flange, and also on the downward facing surface of the sash bottom flange.

With the sash assembled within the outer frame, the gasket strip located on the sash bottom flange is designed to merge with the gasket strips located on the side flanges thereby creating what in operation results in essentially a continuous seal around the sash.

DETAILED DESCRIPTION OF THE PREFERRED EMBODIMENT

Figure 1:
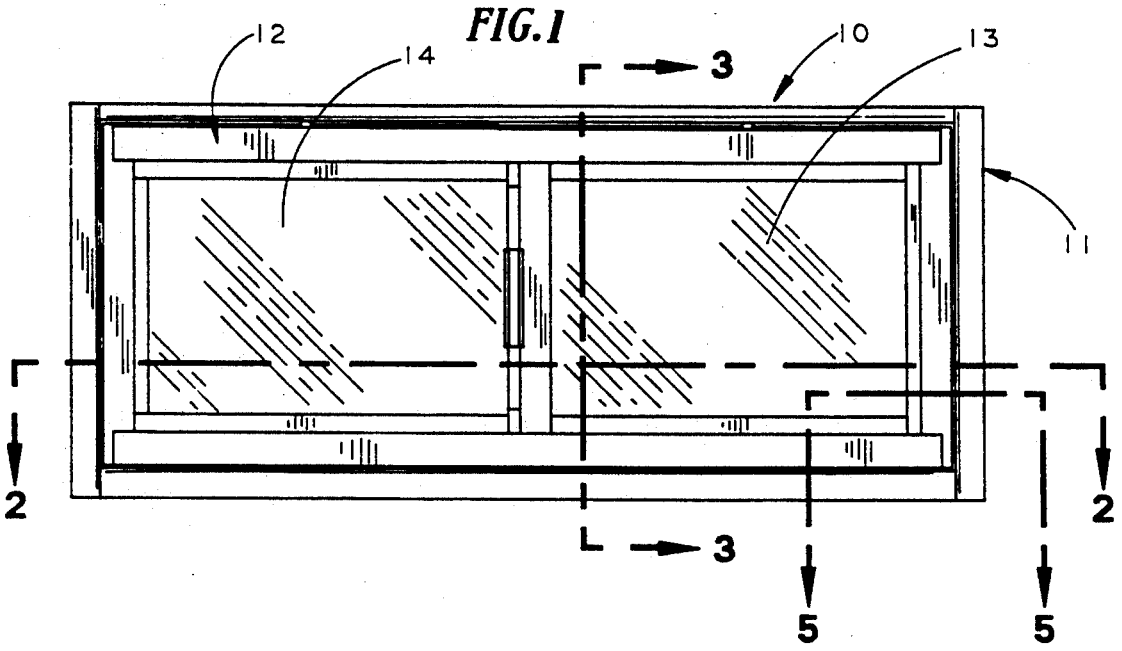
FIG. 1 is a rear elevational view of a casement window frame an sash assembly.
Figure 4:
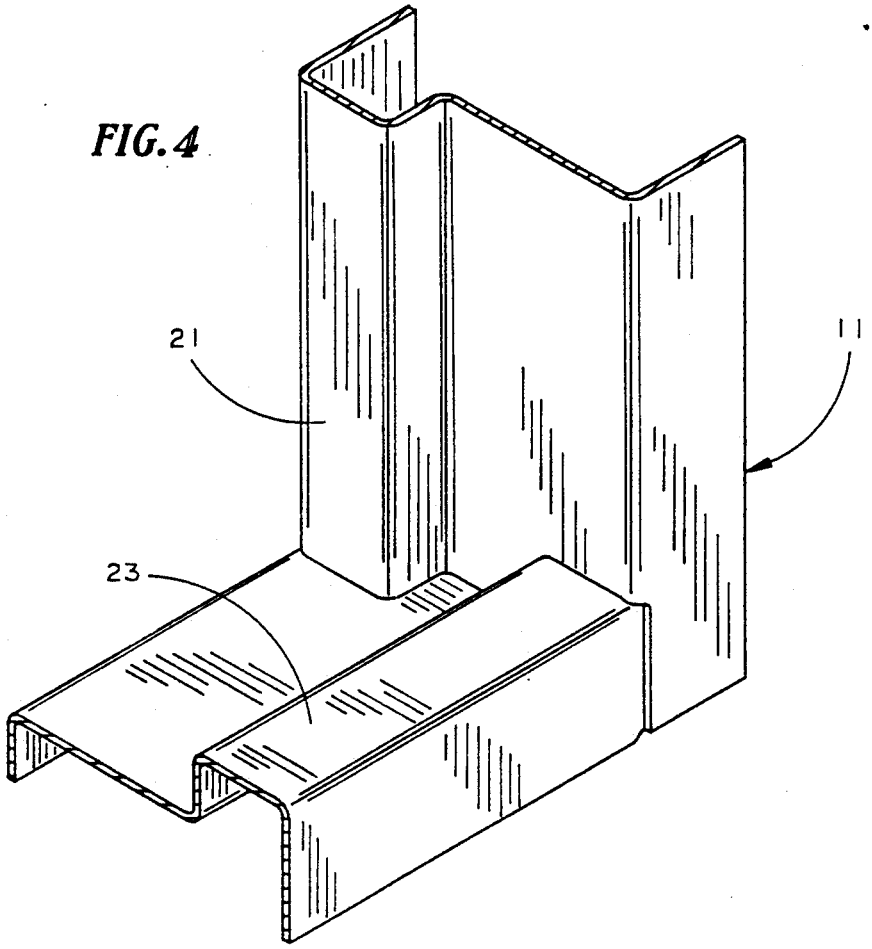
FIG. 4 is a perspective view of a lower corner of the outer frame.

Starting with FIG. 1, a standard type tip-in casement window 10 is shown having an outer frame 11, an inner sash 12, and a slidable glass pane unit 13 and a fixed glass pane unit 14. The general construction of the frame 11 includes an inwardly directed top retaining flange 20 (FIG. 3) and side retaining flange 21 and 22 (FIG. 2) which are located toward the front of the top and side portions, respectively, of the frame 11. Said side flanges 21 and 22 are oppositely situated but similarly constructed. An inwardly directed bottom retaining flange 23 (FIG. 3) is located toward the rear of the bottom portion of the frame 11 thereby establishing, as best depicted in FIG. 4, a transverse relationship between the bottom and side retaining flanges 23, 21 and 22.

Figure 2:
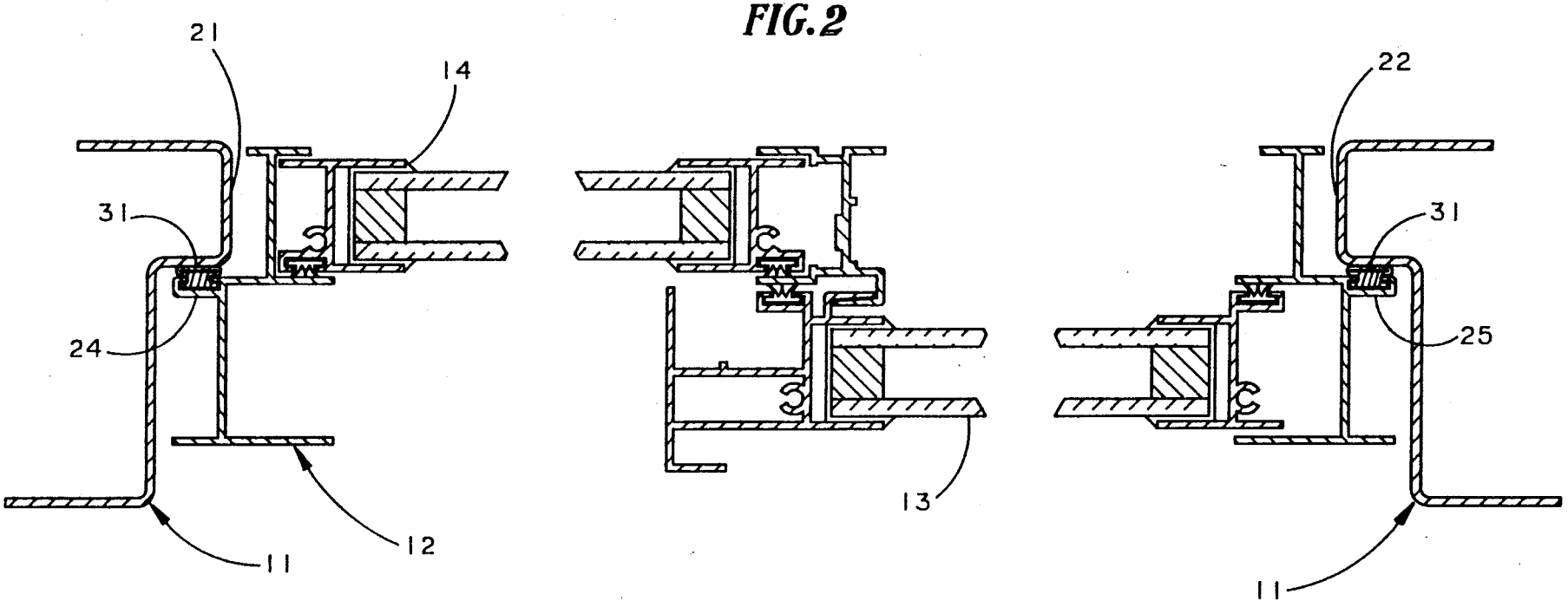
FIG. 2 is a horizontal cross-section view taken along line 2—2 of FIG. 1.
Figure 3:
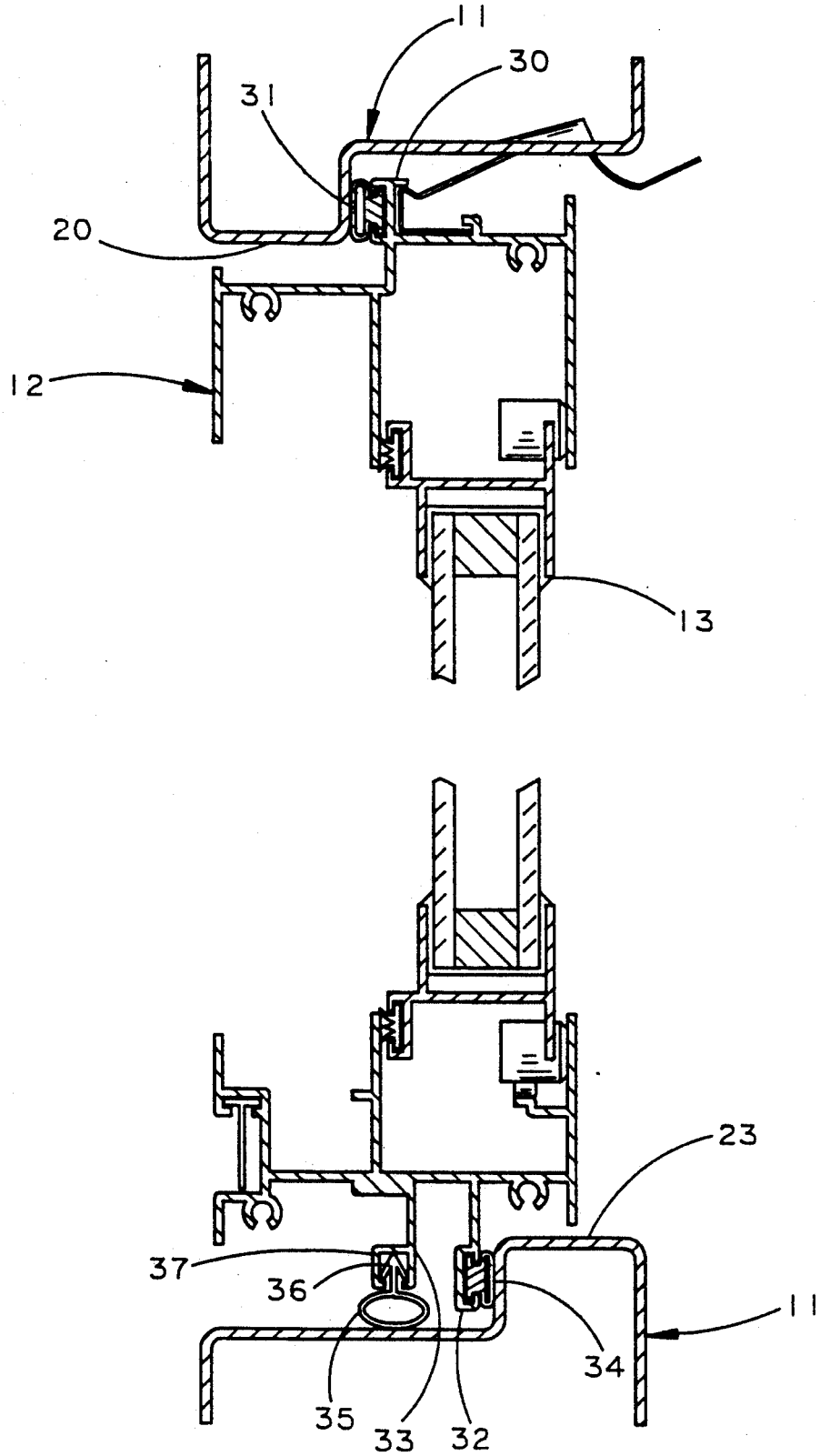
FIG. 3 is a vertical cross-section view taken along line 3—3 of FIG. 1.

Referring now to FIG. 2, the sash 12 is shown having outwardly directed and similarly constructed side flanges 24 and 25 with frontal surfaces designed to abut against the outer frame side retaining flanges 21 and 22 when said casement window 10 is assembled. FIG. 3 shows the sash 12 as also having an outwardly directed top flange 30 with a frontal surface designed to abut against the frame top retaining flange 20. An elongated gasket strip 31, made preferably of a rubber composite material, is retained in the frontal surfaces of the top and side flanges 30, 24 and 25 thereby providing a continuous sealing means between said top and side flanges and the top and side retaining flanges 20, 21 and 22 of the frame 11.

Finally, the sash 12 has outwardly directed inner and outer bottom flanges 32 and 33 (FIG. 3). The inner bottom flange 32 has a rearward facing surface designed to abut against the bottom retaining flange 23, and in a manner similar to that used with the top and side flanges, the rearward surface of the inner bottom flange 32 retains a gasket strip 34 so that the joint between the sash inner bottom flange 32 and the frame bottom retaining flange 22 is sealed. However, because the inner bottom flange 32 is rearward facing, the gasket 34 contained therein is not in contact with the gaskets 31 contained in the side flanges 24 and 25. Therefore, there is not a continuous seal circumferencing the outer perimeter of the sash 12.

Figure 5:
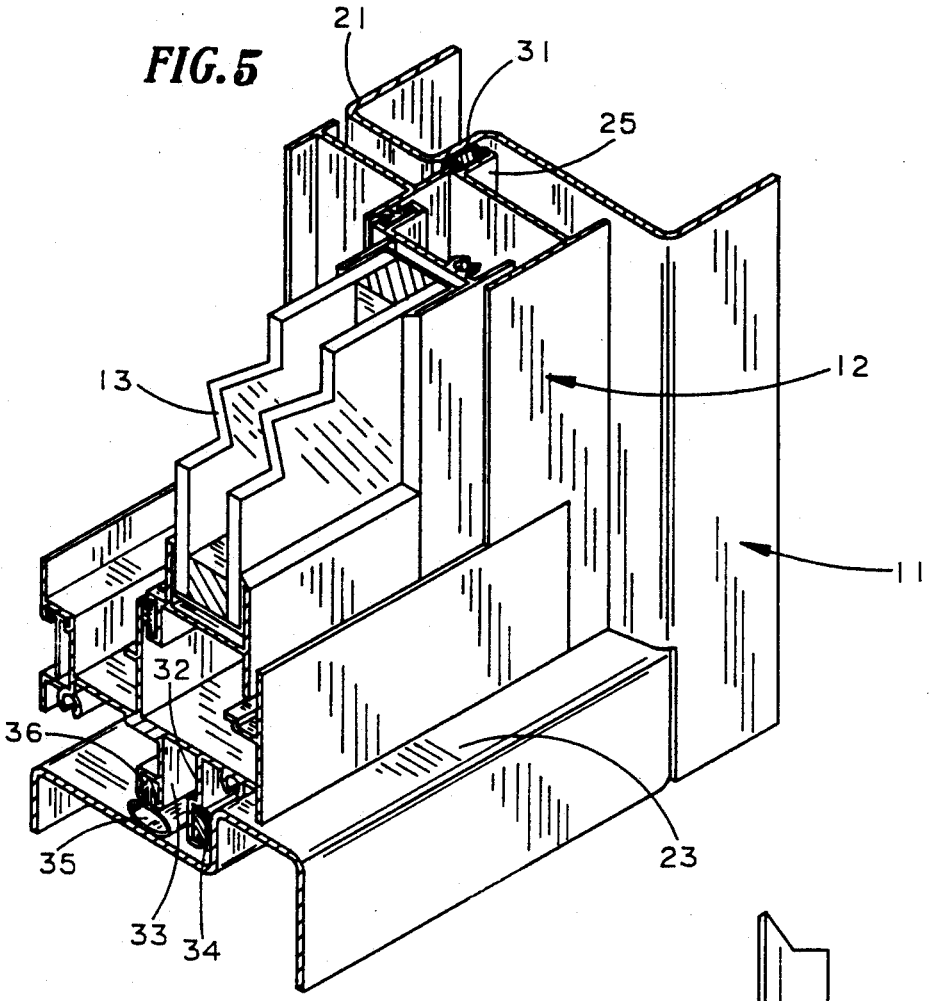
FIG. 5 is a perspective view of the same lower corner of the outer frame shown in FIG. 4 with corresponding lower corners of the sash and window in their assembled positions.
Figure 6:
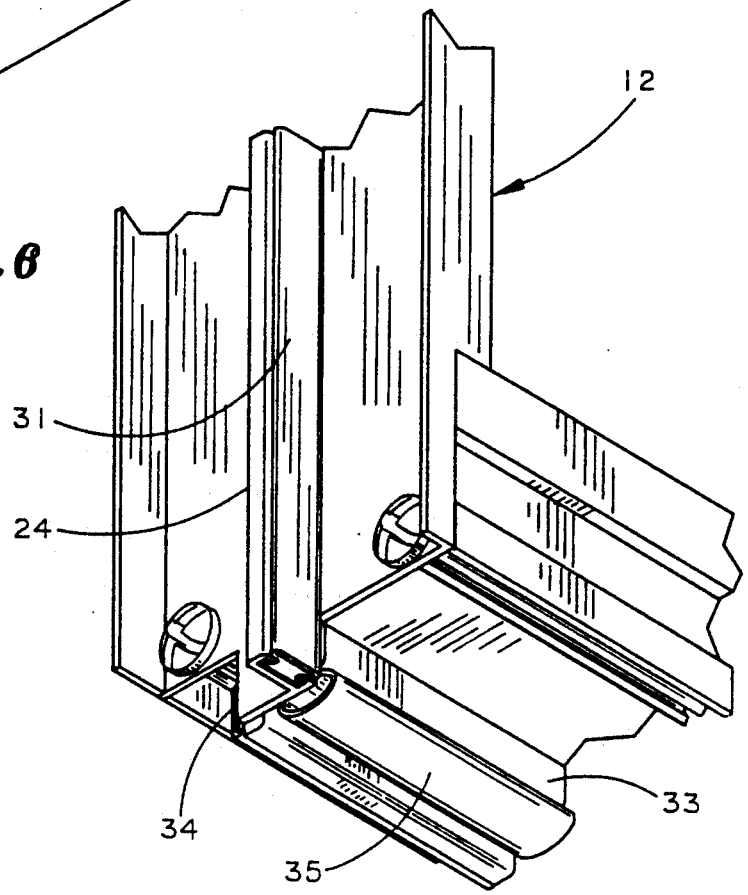
FIG. 6 is a perspective view of the lower corner of the sash and the coacting side and lower sealing means.

The present invention, as shown in FIGS. 3, 5 and 6, provides in operation the continuous seal that is lacking in the prior art. This continuous seal is achieved through a tubular shaped bulb type bottom seal 35 which has an elongated lip portion 36 that is retained in a downward facing elongated channel 37 in a fashion so that the bottom seal 35 is in the same vertical plane that contains the frontward facing edges of the gaskets 31 retained in the top and side flanges 30, 24 and 25 as best shown in FIG. 6. Accordingly, when the window 10 is assembled, the ends of the bottom seal 35 engage the lower ends of the gasket 31 retained in the sash side flanges 24 and 25, thereby creating an operatively continuous seal.

Thus, the present invention provides for continuous sealing around the sash 12 portion of a standard casement window 10. Through the use of the bottom seal 34, the present invention gives the standard type tip-in casement window 10 an insulation efficiency not provided for by prior art devices.

Although a specific preferred embodiment has been shown and described herein, it should be noted by those skilled in the art that modifications and variations can be made to such embodiment without departing from the true spirit and scope of the present invention.

I claim:

1. A casement window having an outer frame and an inner sash frame that are combined together by the sash frame being tipped-into the outer frame and secured therein by retaining clips, said window comprising:

(a) said outer frame having a top and a pair of side retaining flanges toward a front portion of said outer frame;

(b) said outer frame further having a bottom inwardly directed retaining flange toward a rear portion of said outer frame to form a bottom retaining channel together with said side retaining flanges;

(c) said sash frame having a top and a pair of side flanges with frontal surfaces arranged to abut against said top and side retaining flanges of said outer frame;

(d) said sash frame further having a bottom flange transversely spaced apart from said sash frame side flanges;

(e) outwardly facing elongated sealing means disposed on said frontal surfaces of said sash frame top and side flanges to provide a seal between said sash frame flanges and said top and side retaining flanges of said outer frame;

(f) downwardly facing elongated sealing means disposed on an outermost edge of said sash frame bottom flange to provide a seal between said outermost edge and said bottom retaining channel of said outer frame; and (g) said outwardly facing and downwardly facing sealing means having lower end portions adjacent to one another such that when said sash frame is tipped-into said outer frame and secured therein by said retaining clips, said lower end portions of said outwardly facing and downwardly facing sealing means coact to form a sealed joint therebetween and operatively provided a continuous seal between the sash frame and the outer frame.

2. A casement window as recited in claim 6 wherein an inwardly facing elongated sealing means is disposed on a rearward surface of said bottom flange to provide a seal between said flange and said retaining flange of said bottom frame member.

3. A casement window as recited in claim 6 wherein said downwardly facing sealing means is formed of a bulb-type gasket.

4. A casement window as recited in claim 6 wherein said downwardly facing sealing means is formed of an elongated bulb-type portion and a lip portion protruding therefrom and said bottom flange of said sash frame includes a receptacle for receiving and retaining said sealing means lip portion.

* * * * *

UNITED STATES PATENT AND TRADEMARK OFFICE

CERTIFICATE OF CORRECTION

PATENT NO. : 5,245,788
DATED : September 21, 1993
INVENTOR(S) : Harry M. Riegelman It is certified that error appears in the above-identified patent and that said Letters Patent is hereby corrected as shown below:

Title page,
Item [73], Assignee, change the assignee's name from "M & G Manufacturing Company Inc." to -- M & G Manufacturing Company --

Signed and Sealed this

Fifth Day of August, 2003

JAMES E. ROGAN
*Director of the United States Patent and Trademark Office*